US006739868B2

(12) United States Patent
Haefner et al.

(10) Patent No.: US 6,739,868 B2
(45) Date of Patent: May 25, 2004

(54) COMBUSTION CHAMBER ARRANGEMENT

(75) Inventors: Michael Haefner, Stuttgart (DE); Hermann Eppler, Balingen (DE)

(73) Assignee: J. Eberspacher GmbH & Co., Esslingen (DE)

( * ) Notice: Subject to any disclaimer, the term of this patent is extended or adjusted under 35 U.S.C. 154(b) by 0 days.

(21) Appl. No.: 10/614,319

(22) Filed: Jul. 3, 2003

(65) Prior Publication Data

US 2004/0013990 A1 Jan. 22, 2004

(30) Foreign Application Priority Data

Jul. 3, 2002 (DE) ..... 102 29 852

(51) Int. Cl.[7] ..... F23Q 7/08
(52) U.S. Cl. ..... 431/263; 431/262; 237/12.3 C
(58) Field of Search ..... 431/263, 262, 431/261, 264; 126/110 B, 116 R; 237/12.3 C

(56) References Cited

U.S. PATENT DOCUMENTS 3,175,551 A * 3/1965 Panick ..... 126/116 R
4,471,754 A * 9/1984 Galtz ..... 126/110 B
4,818,219 A * 4/1989 Widemann et al. ..... 431/261
4,828,488 A * 5/1989 Reiser et al. ..... 431/263
5,060,855 A * 10/1991 Mohring et al. ..... 237/12.3 C
5,707,227 A * 1/1998 Langen et al. ..... 431/261
5,938,429 A * 8/1999 Brenner ..... 431/262
6,540,151 B1 * 4/2003 Steiner et al. ..... 237/12.3 C

* cited by examiner

*Primary Examiner*—James C. Yeung

(57) ABSTRACT

A combustion chamber arrangement, in particular for a burner of a vehicle heating device, includes a housing arrangement in which a seating region is provided for abutment of a counter-seating region formed on an ignition element. An elastically effective retaining element for retaining the ignition element on the housing arrangement, the retaining element having a first support region supported with respect to the ignition element and a second support region supported with respect to the housing arrangement, wherein the retaining element is supported on at least one of the ignition element or the housing arrangement with the production of a substantially sealed closure of an ignition element passage opening of the housing arrangement.

9 Claims, 1 Drawing Sheet

COMBUSTION CHAMBER ARRANGEMENT

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a combustion chamber arrangement, in particular for a burner of a vehicle, including a housing arrangement, in which a seating region is provided for the abutment of a counter-seating region formed on an ignition element, and also an elastically effective retaining element for retaining an ignition element on the housing arrangement, wherein the retaining element has a first support region supported with respect to the ignition element and a second support arrangement supported with respect to the housing arrangement.

German Patent Document DE-OS 1 551 681 discloses an ignition element supported on a housing. An ignition element lead-in opening or passage opening is provided in the housing, and the ignition element partially passes through it in the mounted state. The ignition element is held on the housing by a retaining element made of sheet metal and has plural retaining flanges. The retaining flanges then lie against an inner peripheral wall of the ignition element lead-in opening and are supported there by their own elasticity for producing the retaining effect.

German Patent Document DE 298 02 226 U1 discloses a combustion chamber arrangement for a vehicle heating device, in which an ignition element is retained in an ignition element lead-in opening such that it partially engages with an end region in the combustion chamber, and the end region is effective for igniting a mixture present in a combustion chamber. A clamp-like retaining element ensures that the ignition element is firmly held to the housing of the combustion chamber arrangement. This clamp-like retaining element is pushed on transversely of the longitudinal direction of the ignition element, or in the direction in which the ignition element is pushed into the ignition element lead-in opening.

European Patent Document EP 0 579 157 B1 discloses an ignition element held on a housing, and a clamp-like spring element is provided that under its elastic prestress fixes the ignition element on the housing.

SUMMARY OF THE INVENTION

The present invention has as its object to provide a combustion chamber arrangement, in particular for a burner of a vehicle heating device, in which better functionality can be achieved in the region of the retaining of an ignition element on a housing.

This object is attained according to the invention by a combustion chamber arrangement, particularly for a burner of a vehicle heating device, including a housing arrangement in which a seating region is provided for abutment of a counter-seating region formed on an ignition element, and also an elastically effective retaining element for retaining an ignition element on the housing arrangement. The housing element has a first support region supported with respect to the ignition element and a second support region supported with respect to the housing arrangement.

It is furthermore provided that the retaining element is supported on the ignition element and/or the housing arrangement with the production of a substantially sealed closure of an ignition element passage opening of the housing arrangement.

The combustion chamber arrangement according to the invention requires that the retaining element for retaining the ignition element on the housing arrangement serves a double function, in that at the same time it also ensures a sealed closure of the housing arrangement in the region of this retention. Thus no additional sealing elements need be provided. This simplifies the structure and reduces the production costs by integration of functions in a single component.

For example, it can be provided that the retaining element has in its second support region a support projection that (with respect to the ignition element passage opening) abuts at least partially around, and substantially over its whole peripheral length, on the housing arrangement. For achieving a defined cooperative effect between the retaining element and the housing arrangement, it is proposed that a support surface is formed on the housing arrangement, at least locally surrounding the ignition passage opening and associated with the support projection.

The retaining element and the housing arrangement can be held together against undesired release in that the support projection engages over the support surface like a barb, so that for a satisfactory sealed closure it can be ensured that the support projection has a sealing lip region abutting under prestress against the support surface.

The retaining element can, for example, be formed like a pot and can have the first support region in a floor region and the second support region in a wall region.

When the ignition element is prestressed with its counter-seating region in abutment on the seating region by the retaining element, on the one hand, the ignition element is retained in a defined manner with respect to the housing arrangement, and the occurrence of clicking noises can be avoided. On the other hand, this abutment produces an advantageous reaction force for attaining a sealed closure.

The holding element can be formed of rubber-elastic material. Preferably natural or synthetic rubber materials are used here. Care must be taken that these materials have to be resistant to this surrounding atmosphere and, in addition, must be heat resistant in the temperature range in which such arrangements operate.

BRIEF DESCRIPTION OF THE DRAWINGS

The present invention is described in detail hereinafter with reference to the accompanying FIGURE, in which a section of a combustion chamber arrangement is shown.

DETAILED DESCRIPTION OF THE INVENTION

Figure 1:
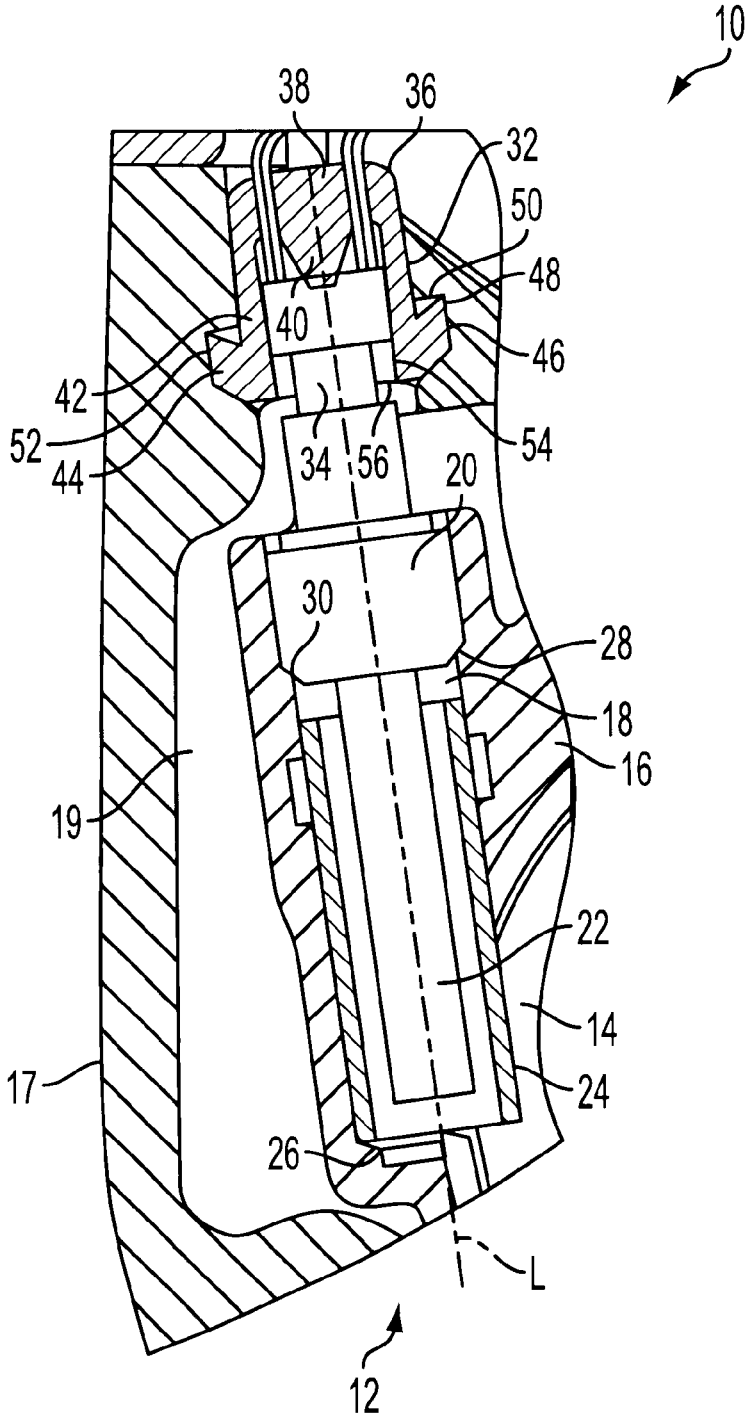

A section of a combustion chamber arrangement, generally denoted by the reference numeral 10, is shown in the FIGURE. This section shows a portion of a housing arrangement 12. A housing portion 16 of the housing arrangement 12 bounds a combustion chamber 14, visible only partially, and has a recess 18 formed with a, for example, circular contour and at least partially receiving in the assembled state a combustion element 20 formed, for example, as a glow ignition pin. A pressure space 19 is formed between the housing portion 16, already mentioned and bounding the combustion chamber 14, and a further housing portion 17 connected to this and, for example, even integrally formed. Compressed air is provided via this pressure space 19 by means of a fan for feeding into the combustion chamber 14. A section 22 of the ignition element 20 that becomes thermally effective for ignition projects at least into the region of the combustion chamber 14 and is surrounded by a porous material 24 formed like a bushing. This porous material 24 is also partially situated in the recess 18 and can be supported on a floor region 26 of this recess 18 in the direction of a long axis L of the same.

The recess 18 forms a conical seating surface 28, on which a correspondingly formed counter-seating surface 30 of the ignition element 20 abuts. In this manner, the position of the ignition element 20 with respect to the housing arrangement 12 is defined and fixed. Furthermore, a lead-in opening or passage opening 32 for the ignition element 20 is provided in the housing portion 17 of the housing arrangement 12 as an axial extension of the recess 18, and the ignition element 20 is guided through the opening 32 when being inserted into the housing arrangement 12. In the mounted state shown in the Figure, the ignition element 20 projects with its rear end region 34 into the opening 32. A retaining element 36, formed like a cap or pot, is pushed over the end region 34 of the ignition element 20. The retaining element 36 has a floor region 38, from which a first support region 40 extends to the end region 34 of the ignition element 20 and abuts on this. A wall region 42 adjoins the floor region 38, surrounds the end region 34 of the ignition element 20, and is adapted in its shape to the inner peripheral shape of the opening 32, and thus has, for example, a circular external peripheral form. The wall region 42, in its end region placed in the direction of the longitudinal axis L of the opening, has a projection 44 annularly running around the latter and standing radially outward. In the assembled state, this projection 44 is substantially completely received in an annular groove-shaped widening 46 of the opening 32. The projection 44 is formed like a barb, so that in the fitted-in state it is supported with a sealing lip region 48 on a support surface 50, running annularly around the opening 32 of the housing 12, or abuts with an outer peripheral surface 52 on a floor wall of the widening 46.

The retaining element 36 is produced from rubber-elastic material that is thus elastically deformable. The retaining element 36 is dimensioned such that in the state shown in the Figure it abuts under prestress on both the glow ignition pin 20, namely with its first support region 40, and also on the housing arrangement, namely with its projection 44 substantially forming a second support region. It is thereby attained that the ignition element 20 is prestressed with its counter-seating surface 30 in firm abutment contact on the seating surface 28 by the retaining element 36. Furthermore, a sealed closure of the opening 32 is attained. Contributing to this, the retaining element 38 abuts with its sealing lip region 48 on the support surface 50, with its outer peripheral surface 52 on the floor region of the widening 46, and with its substantially conical or frustroconical end surface 54 on a corresponding abutment surface 56 of the housing arrangement 12. Moreover, the dimensioning of the projection 44 is chosen so that preferably an abutment under elastic prestress occurs in all the three regions previously mentioned. Thus the volume region surrounded by the housing 12 is closed by the retaining element 36 against any materials leaving through the opening 32, and of course also against any materials entering through the opening 32. In order to supply the ignition element 20 with electrical energy, it is possible to provide passage openings for electrical leads in the floor region 38 of the retaining element 36. Particularly when the dimensioning of the retaining element 36 is chosen so that this abuts with its wall region 42, or with an outer peripheral surface of the same, under prestress on the inner peripheral wall of the opening 32 and simultaneously also under prestress with an inner peripheral surface of the wall 42 at the end region 34 of the ignition element 20, no sealing problem also arises in the region of the lead-in for the electrical leads, since a sealed closure between the retaining element 36 and the ignition element 20 on the one hand, and the retaining element 36 and the housing 12 on the other hand, is already implemented at a region situated near to the combustion chamber 14.

In the combustion chamber arrangement 10, the retaining element 36 thus fulfills a double function, in that on the one hand, it holds the ignition element 20 in firm contact with the housing arrangement 12, namely the housing portion 16 of the same and, on the other hand, effects a sealed closure of an opening through which the ignition element 20 is introduced into the housing arrangement 12. Furthermore, because of the elasticity of the retaining element 36, this can also compensate for manufacturing tolerances.

When incorporating the ignition element 20 into the housing arrangement 12, it can be pushed, together with the retaining element 36 already provided at the end region 34, through the opening 32 and into the recess 18, so that the retaining element 36, while being elastically deformed, and surrounding the end region 34, enters the opening 32 and latches, expanding elastically, with its projection 44 into the groove-like widening 46. Alternatively, it is also possible to design the opening 32 in which the retaining element is to be positioned so that it is open transversely of the axis L, and thus, for example, is open upward from the plane of the diagram of the Figure. The retaining element 36 can then be pushed laterally, together with the end region 34 already received therein, into the opening 32. The opening 32 can thereupon be closed on this side also by a further housing part, for example a housing cover. In this embodiment, the retaining element can be formed so that the projection 44 providing a support region is provided only on that peripheral region, which is received in the opening 32 of the housing portion 17 of the retaining element 36, which is then not necessarily provided with a circular periphery on the outside. On the side on which a further housing part, for example a housing cover, then ensures closure of the opening 32 and of course also of the pressure space 19, the retaining element 36 can have a flattened surface that substantially abuts with its full surface on this further housing part. It should also be mentioned in regard to the ignition element 20 that the opening 18 receiving this does not necessarily have to be fully closed in the peripheral direction, but that here likewise, by leaving this opening 18 open laterally, the ignition element 20 can be inserted laterally, if necessary together with the porous material 24. Here also, lateral closure can take place by a further housing part or a housing cover.

It should be mentioned that it goes without saying that above all the construction described hereinabove of the housing arrangement 12 can be different. It is, of course, possible for the recess 18 to directly adjoin the opening 32 and for the opening 32 to form a portion of the recess 18. It is also possible, as mentioned, to form the housing arrangement 12 of plural portions and, for example, to provide the recess 18 on one portion and the opening 32 on another portion.

We claim:

1. A combustion chamber arrangement, in particular for a burner of a vehicle heating device, comprises a housing arrangement (12) in which a seating region (28) is provided for abutment of a counter-seating region (30) formed on an ignition element (20); an elastically effective retaining element (36) for retaining the ignition element (20) on the housing arrangement (12), the retaining element (36) having a first support region (40) supported with respect to the ignition element (20) and a second support region (44) supported with respect to the housing arrangement (12), wherein the retaining element (36) is supported on at least one of the ignition element (20) or the housing arrangement (12) with the production of a substantially sealed closure of an ignition element passage opening (32) of the housing arrangement (12).

2. The combustion chamber arrangement according to claim 1, wherein the retaining element (36) has in its second support region (44) a support projection (44) which, with respect to the ignition element passage opening (32), abuts at least partially running around, and substantially over its whole peripheral length on, the ignition element passage opening (32).

3. The combustion chamber arrangement according to claim 2, wherein a support surface (50) is formed on the housing arrangement (12), allocated to the support projection (44), and at least locally surrounding the ignition element passage opening.

4. The combustion chamber arrangement according to claim 3, wherein the support projection (44) engages like a barb over the support surface (50).

5. The combustion chamber arrangement according to claim 3, wherein the support projection (44) has a sealing lip region (48) abutting under prestress on the support surface (50).

6. The combustion chamber arrangement according to claim 4, wherein the support projection (44) has a sealing lip region (48) abutting under prestress on the support surface (50).

7. The combustion chamber arrangement according to claim 2, wherein the retaining element (36) is formed pot-shaped and has the first support region (40) in a floor region and has the second support region (44) in a wall region (42).

8. The combustion chamber arrangement according to claim 2, wherein the retaining element (36) prestresses the ignition element (20) with its counter-seating region (30) into abutment on the seating region (28).

9. The combustion chamber arrangement according to claim 1, wherein the retaining element (36) is formed of rubber-elastic material.

* * * * *